US005584443A

United States Patent [19]

Butterworth

[11] Patent Number: 5,584,443

[45] Date of Patent: Dec. 17, 1996

[54] REWINDER LOG CONTROL

[75] Inventor: Tad T. Butterworth, Ashland, Wis.

[73] Assignee: C.G. Bretting Manufacturing Company, Inc., Ashland, Wis.

[21] Appl. No.: 626,754

[22] Filed: Apr. 2, 1996

Related U.S. Application Data

[63] Continuation of Ser. No. 274,643, Jul. 13, 1994, abandoned.

[51] Int. Cl.[6] ..... B65H 18/14; B65H 18/26

[52] U.S. Cl. ..... 242/542; 242/542.2

[58] Field of Search ..... 242/542, 542.1, 242/542.2, 533, 533.3, 547, 520

[56] References Cited

U.S. PATENT DOCUMENTS

| | | | |
|---|---|---|---|
| 3,123,315 | 3/1964 | Couzens | 242/56 |
| 3,389,592 | 6/1968 | Bournez et al. | 242/533 |
| 4,327,877 | 5/1982 | Perini | 242/66 |
| 4,487,377 | 12/1984 | Perini | 242/56.8 |
| 4,508,283 | 4/1985 | Beisswanger | 242/542 X |
| 4,575,018 | 3/1986 | Ichikawa | 242/542.2 X |
| 4,635,867 | 1/1987 | Kytonen | 242/542 X |
| 4,892,119 | 1/1990 | Hugo | 129/1 R |
| 4,909,452 | 3/1990 | Hertel | 242/56 R |
| 4,931,130 | 6/1990 | Biagiotti | 156/446 |
| 4,932,599 | 6/1990 | Doerfel | 242/56.4 |
| 4,988,051 | 1/1991 | Welschlau | 242/56 R |
| 5,031,850 | 7/1991 | Biagiotti | 242/66 |
| 5,040,738 | 8/1991 | Biagiotti | 242/66 |
| 5,137,225 | 8/1992 | Biagiotti | 242/66 |
| 5,226,611 | 7/1993 | Butterworth | 242/527 |

*Primary Examiner*—John Q. Nguyen

*Attorney, Agent, or Firm*—Reinhart, Boerner, Van Deuren, Norris & Rieselbach, s.c.

[57] ABSTRACT

A rewinder log control for decelerating soft paper logs including a pair of log control fingers having opposed distal concave portions defining a cylindrical cavity for contacting a spinning log after a rewinding operation. The log control fingers also have proximal convex portions for nesting in adjacent diameter control roll grooves to permit positioning the log control fingers out of the way for core insertion and log rewinding. A cam plate having a cam track is mounted on the rewinder machine frame and a cam follower coupled to the log control fingers moves along the track as the machine moves through its rewinding cycle to move the fingers between a first or clearance position and a second or deceleration position.

21 Claims, 6 Drawing Sheets

REWINDER LOG CONTROL

This application is a continuation of application Ser. No. 08/274,643, filed on Jul. 13, 1994, abandoned.

BACKGROUND OF THE INVENTION

This invention relates to the field of paper converting, more particularly to rewinding a web of paper into paper logs which are preferably relatively small diameter rolls of paper typically wound on cardboard tubular cores and suitable for cutting into short axial segments resulting ultimately in consumer-sized rolls of toilet paper or kitchen towels or the like. This rewinder log control is particularly suited for controlling the finished logs of soft rolls at high speed such as are produced by equipment as disclosed in U.S. Pat. No. 5,226,611, titled TWIN STATION REWINDER, the disclosure of which is hereby expressly incorporated herein by reference.

It has been observed that soft logs of bathroom tissue or kitchen towels act as out of balance flexible rotors when winding at high speed. During the winding process the log is contained between three rolls which provide very good control of the log. At the end of the winding process, the diameter control rolls open and the rotating log is released to fall into a log deceleration receiver. This system works well for unembossed "hard" logs which are relatively dense, rigid and dynamically balanced. Embossed logs are relatively soft, flexible and lightweight, resulting in unpredictable behavior when the diameter control rolls open, and the log is released to the log deceleration receiver. Left uncontrolled, such soft logs have been found to move out of a right cylindrical column and form an arc while still spinning and also to bounce out of the log receiver. One approach has been to reduce the winding speed to prevent damage to the outer sheets of paper on the logs and to assure the log will enter and remain in the receiver during deceleration. However, lower rewinding speeds result in less efficient production and consequent higher costs.

The present invention overcomes these difficulties by providing an improved structure and method of decelerating soft paper logs before delivery to the log receiver, permitting maintenance of high winding speeds and rapid and positive control of the logs after rewinding is completed and before the soft logs are released. The present invention includes a pair of log control fingers which are movable from a clearance position (maintained while the log is rewound) to a braking position in which the fingers trap the log and quickly bring it to a complete stop as the diameter control rolls open to release the finished log. The combination of continuous three roll contact throughout the winding process followed by containment in a cavity formed by the fingers resulting in rapid deceleration of the log in the winding area results in a satisfactory operation for winding soft logs at high speed. The log control fingers are located in grooves in the diameter control rolls, and remain below the surface of the diameter control rolls during the winding process where they have no effect on the winding process. At the completion of winding, the fingers are actuated out of the diameter control rolls and trap the log, bringing it to a stop before dropping it into the receiver. The fingers can be actuated by a cam or air cylinder or other suitable means. In a preferred embodiment, a cam is used which is adjustable to various diameter logs, with the adjustment available to the machine operator while the equipment is running. It has been found that stopping rotation of the log before delivery to the receiver reduces the design requirements for the receiver.

DETAILED DESCRIPTION

Figure 1:
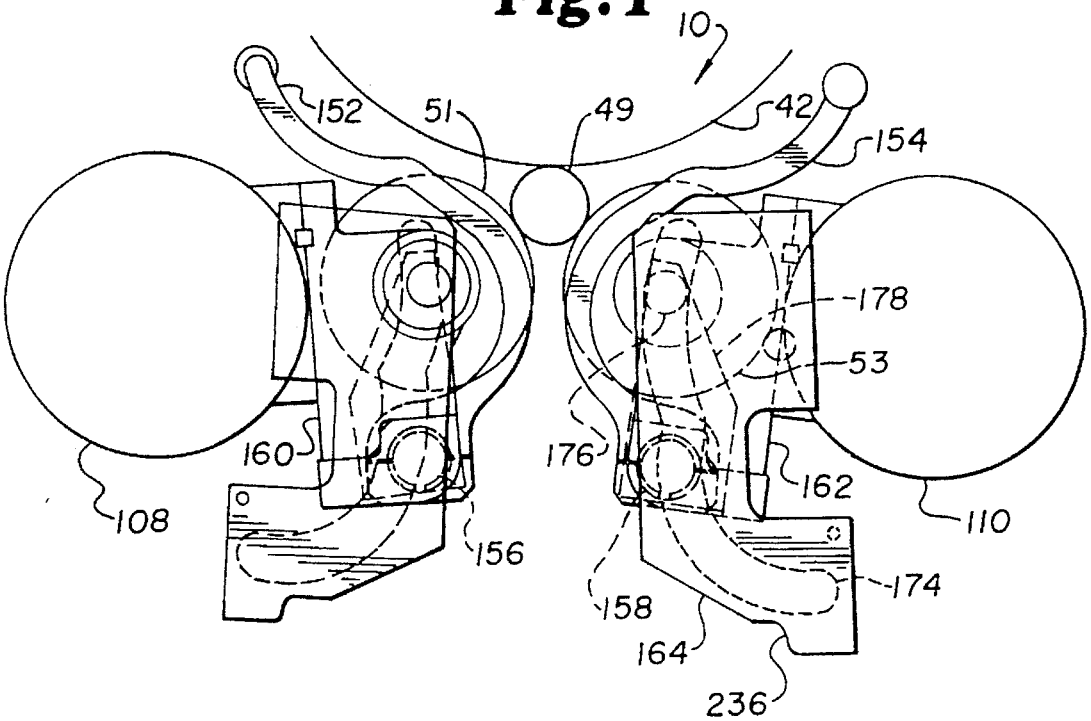
FIG. 1 is an end view of a portion of a winding machine showing the beginning of a rewinding operation on a core on which a paper log is rewound.

Referring to the Figures, and most particularly to FIG. 1, a portion of a twin station rewinder 10 of the type more fully disclosed in U.S. Pat. No. 5,226,611 is shown. Twin station rewinder 10 includes a winding roll 42 and a pair of diameter control rolls 51, 53 mounted for pivoting movement by respective pivot mechanisms 108, 110. In the position shown in FIG. 1 a core 49 is positioned in contact with winding roll 42 and diameter control rolls 51 and 53 at the commencement of winding a paper log 54 (see FIGS. 2, 3 and 4).

Figure 5:
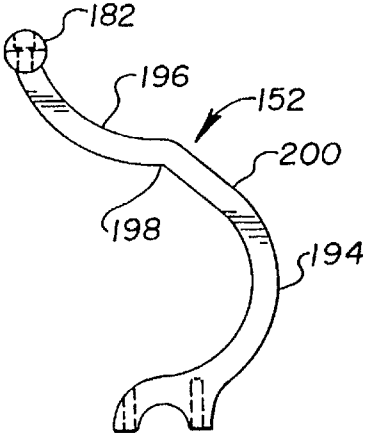
FIG. 5 is an end profile view of a log control finger.
Figure 7:
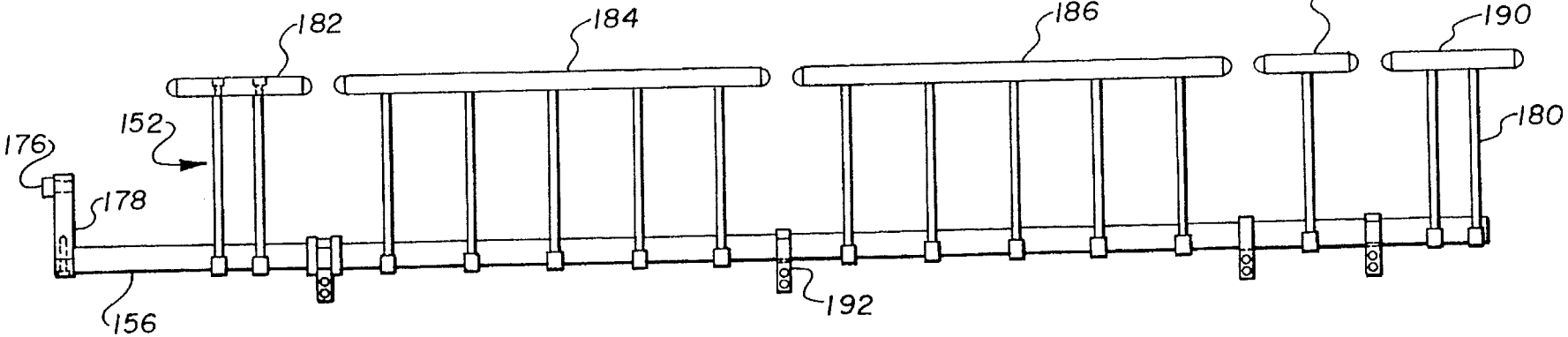
FIG. 7 is a side view of the log control finger assembly.

The present invention preferably includes a pair of sets of right and left hand log control fingers 152, 154 (see also FIGS. 5 and 7). Fingers 152, 154 are mounted on respective shafts 156, 158 rigidly so as to rotate with rotation of the respective shaft. Shafts 156, 158 are preferably mounted for at least limited rotational movement in mounting brackets 160, 162, each of which is secured respectively, to the pivot mechanisms 108, 110.

Figure 8:
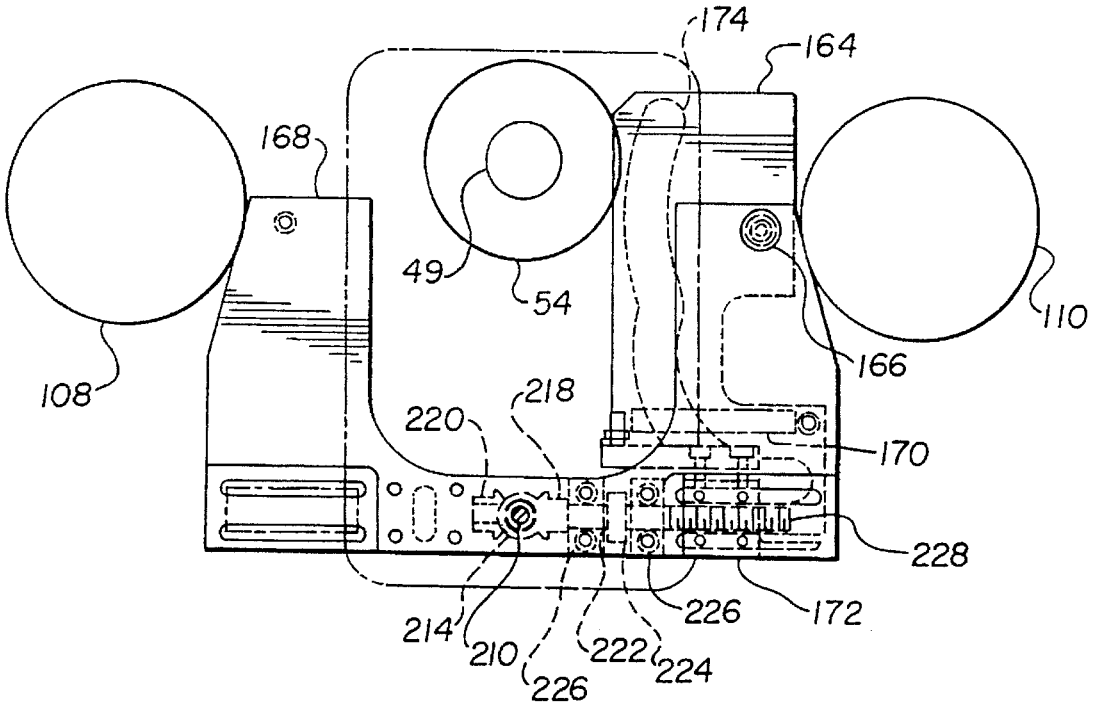
FIG. 8 is an end view of an adjusting mechanism useful in the practice of the present invention.
Figure 9:
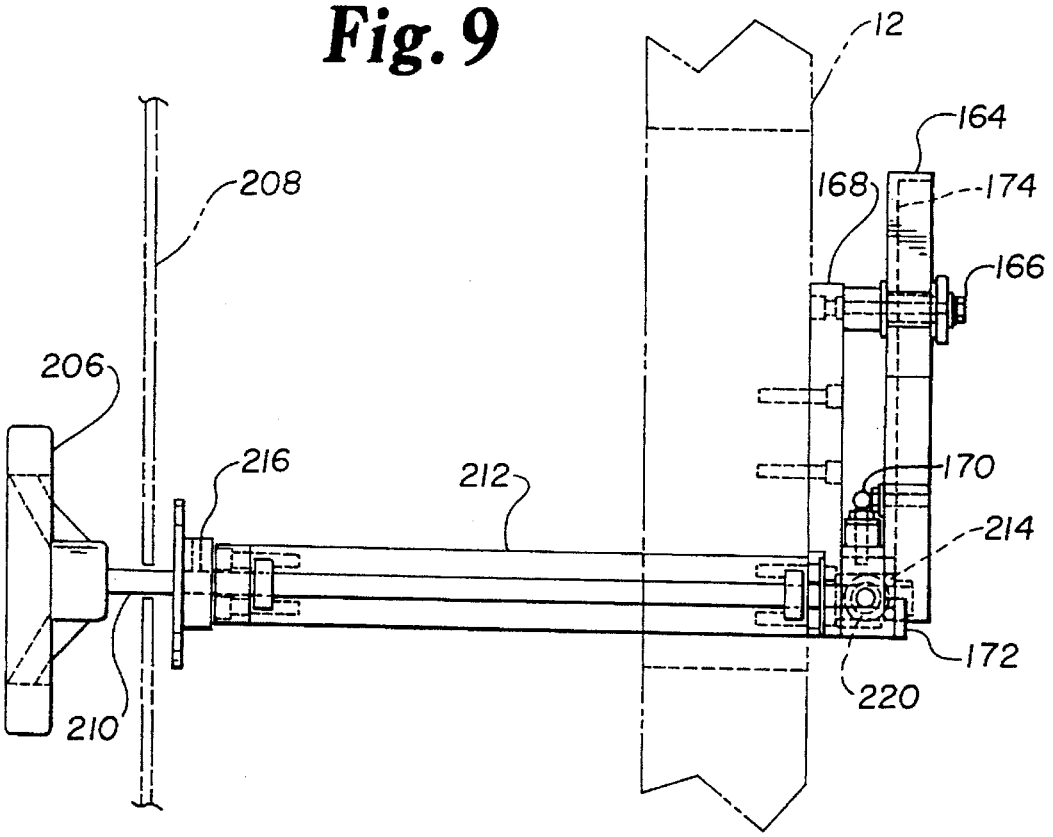
FIG. 9 is a side view of the adjusting mechanism of FIG. 8.
Figure 10:
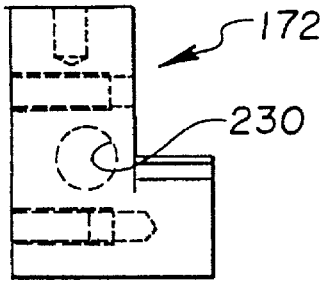
FIG. 10 is a side view of a cam stop useful in the practice of the present invention.
Figure 11:
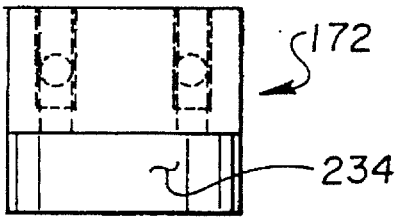
FIG. 11 is an end view of the cam stop of FIG. 10.
Figure 12:
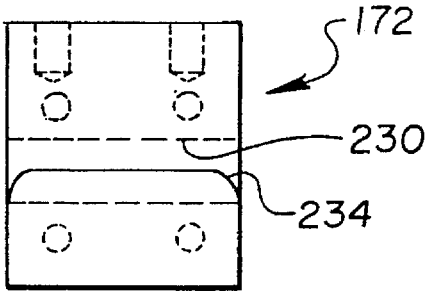
FIG. 12 is a top view of the cam stop of FIG. 11.

Referring now also to FIGS. 8 and 9, a cam plate 164 is pivotably mounted via a pivot 166 to a cam support plate 168. The cam support plate 168 is mounted to a frame 12 of rewinder 10. It is to be understood that cam plate 164 is free to pivot with respect to cam support plate 168 via pivot 166, but is restrained and urged toward the position shown in FIG. 8 by a cam overload spring 170 which urges cam plate 164 against a cam stop 172. Cam stop 172 may be seen more clearly in FIGS. 10, 11 and 12.

Figure 6:
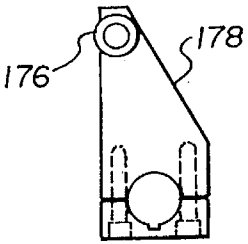
FIG. 6 is an end view of the cam follower arm of the log control finger assembly.

Cam plate 164 has a cam track 174 therein. Referring also to FIGS. 6 and 7, a cam follower 176 is mounted to shaft 156 via a follower support arm 178.

It is to be understood that only one cam plate 168 is shown in FIGS. 1–4, although there are in reality four cam plates, with two cam plates at each side of the machine, one right hand and one left hand corresponding to the opposed log control fingers 152, 154.

It is to be understood that log control finger 152 is in reality a plurality of identical members 180 connecting shaft 156 to various cross-tie members 182–190, as may be seen most clearly in FIG. 7. The respective cross-tie members 182–190 are separated and spaced apart from each other to permit movement of other machine elements, notably the core inserter (see inserter 112 in U.S. Pat. No. 5,226,611). Cross-tie members 182–190 are oriented parallel to a cylindrical axis of the diameter control rolls, 51, 53. The cross-tie members have been found useful to prevent tearing the trailing edge of a web as rewinding of the log 54 is completed and the finished log is spinning in the region between the diameter control rolls 51, 53 and the winding roll 42, especially when the log control fingers 152, 154 move towards the log 54 to decelerate it.

Referring now to FIG. 5, log control finger 152 has a convex portion 194 proximal to shaft 156 and a concave portion 196 distal of shaft 156. Fingers 152 also preferably have a discontinuity 198 and a straight line portion 200 intermediate the proximal convex portion 194 and the distal concave portion 196 of log control finger 152.

Figure 2:
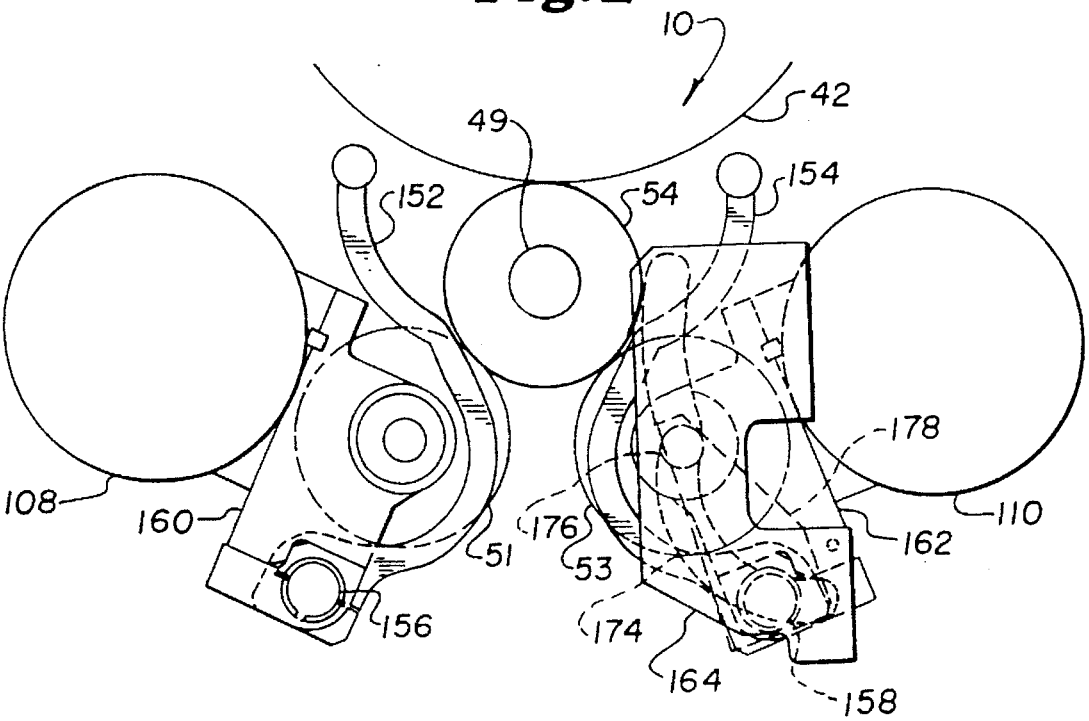
FIG. 2 is a view similar to that of FIG. 1 but with the rewinding operation advanced to near completion of the rewound paper log.
Figure 3:
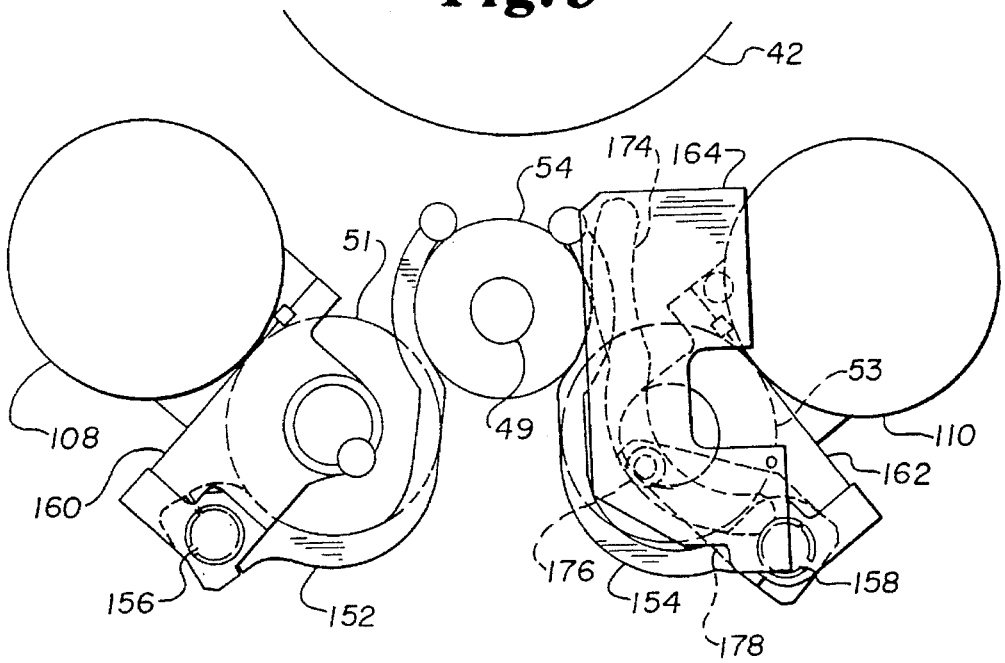
FIG. 3 is a view similar to that of FIG. 2 but with the log rewound and disengaged from the winding rolls and held by the log control fingers during deceleration immediately after completion of the rewinding operation.

It is to be understood that the proximal convex portion 194 is adapted to nest in a groove in its respective diameter control roll when the log control finger 152 is in the first position. It is further to be understood that the distal concave portions of the log control fingers 152, 154 form a cavity when the fingers are in the second position with the cavity having a diameter less than the finished diameter of the paper log 54 (all as shown in FIG. 3.) The discontinuity is a form of "cusp" or corner in the transition from the concave to the convex portions of the log control fingers. Forming the fingers with this corner 198 permits the fingers to have a greater "angle of wrap" around the log when they are moved to the second position for decelerating the log. The straight line portion 200 similarly permits shaping the fingers to have a better "grasp" on the log, and to assists in moving the log away from the respective diameter control roll as the finger moves out of the diameter control roll groove. The circumferential arc length of the concave portion in contact with the log will vary with log diameter; it is to be understood that it is preferable to have as much surface area as possible in contact between the fingers and the log. In the embodiment shown in FIGS. 1–4, each finger is in contact with the log over at least sixty and preferably approximately ninety degrees of circumferential arc length. Although the Figures show a uniform circular configuration for the log 54, it is to be understood that, in practice, fingers 152, 154 may deform the log slightly when decelerating it, particularly with relatively "soft" logs.

Figure 13:
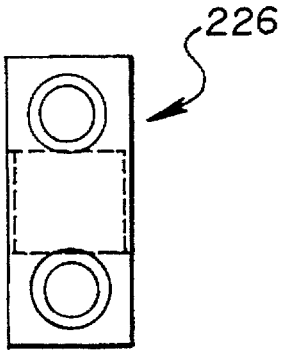
FIG. 13 is an end view of a bearing support useful in the practice of the present invention.
Figure 14:
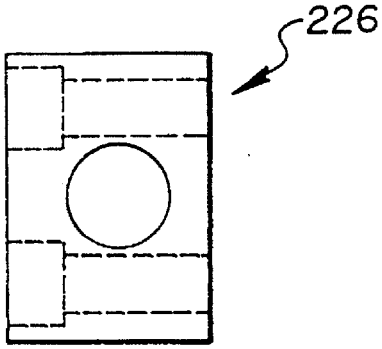
FIG. 14 is a side view of the bearing support of FIG. 13.

Referring now to FIGS. 8 and 9, certain aspects of a means for positioning the log control fingers may be seen. A cam adjustment handle 206 is available to the machine operator (since it is positioned exterior of a machine guard 208). Handle 206 is rigidly secured to shaft 210 which is supported by an elongated frame 212 and shaft 210 carries a miter gear 214. Shaft 210 also carries a sprocket 216 which is coupled via a chain (not shown) to a counter-shaft (also not shown) to an identical assembly to that shown in FIGS. 8 and 9 on the opposite side of the machine. Miter gear 214 engages a pair of driven miter gears 218, 220. Gear 218 is connected to a threaded shaft 222 which is prevented from moving axially by collar 224. Shaft 222 is supported for rotational movement by bearing supports 226, which may be seen in more detail in FIGS. 13 and 14. It is to be understood that a conventional sleeve bearing is pressed into bearing support 226 and that conventional thrust washers may be provided on the shaft 222 intermediate collar 224 and bearing support 226. The threaded end 228 of shaft 222 engages a threaded bore 230 in a cam stop 172, which may be seen in detail in FIGS. 10, 11 and 12. Cam stop 172 also preferably has a stop surface 234 (see FIG. 12) which is adapted to mate with a concave mating surface 236 in cam plate 164 (see FIG. 1). The position of cam stop 172 with respect to support plate 168 may be adjusted by adjusting hand wheel 206. This provides for adjustment of cam plates 164 and moves the track 174 with respect to frame 12 to adjust the spacing between the fingers 152, 154 while the fingers are in the second position (as shown in FIG. 3) to accommodate different finished diameter paper logs 54.

Returning now to FIGS. 1–4, the operation of the rewinder log control of the present invention may be seen. In FIG. 1 an empty core 49 has been inserted by a core inserter (not shown) and the diameter control rolls 51, 53 have been rotated about the centers of pivot mechanisms 108, 110 to provide three-point contact with core 49, the three points of contact being at the diameter control rolls 51, 53 and the winding roll 42. It is to be understood that a web of paper is transferred from winding roll 42 to core 49 and is wound on the core 49 to build a log 54, as shown in FIG. 2. As the log is building the diameter control rolls 51, 53 gradually pivot away from the winding roll 42 while still maintaining the three-point contact to positively rewind log 54. Pivoting occurs about pivot mechanisms 108, 110 with the pivot points being concentric with the circles 108, 110. Throughout the winding operation shown in FIGS. 1 and 2, the log control fingers 152, 154 remain in the first position with respect to the diameter control rolls 51, 53 for providing clearance to the paper log 54 being rewound.

Figure 4:
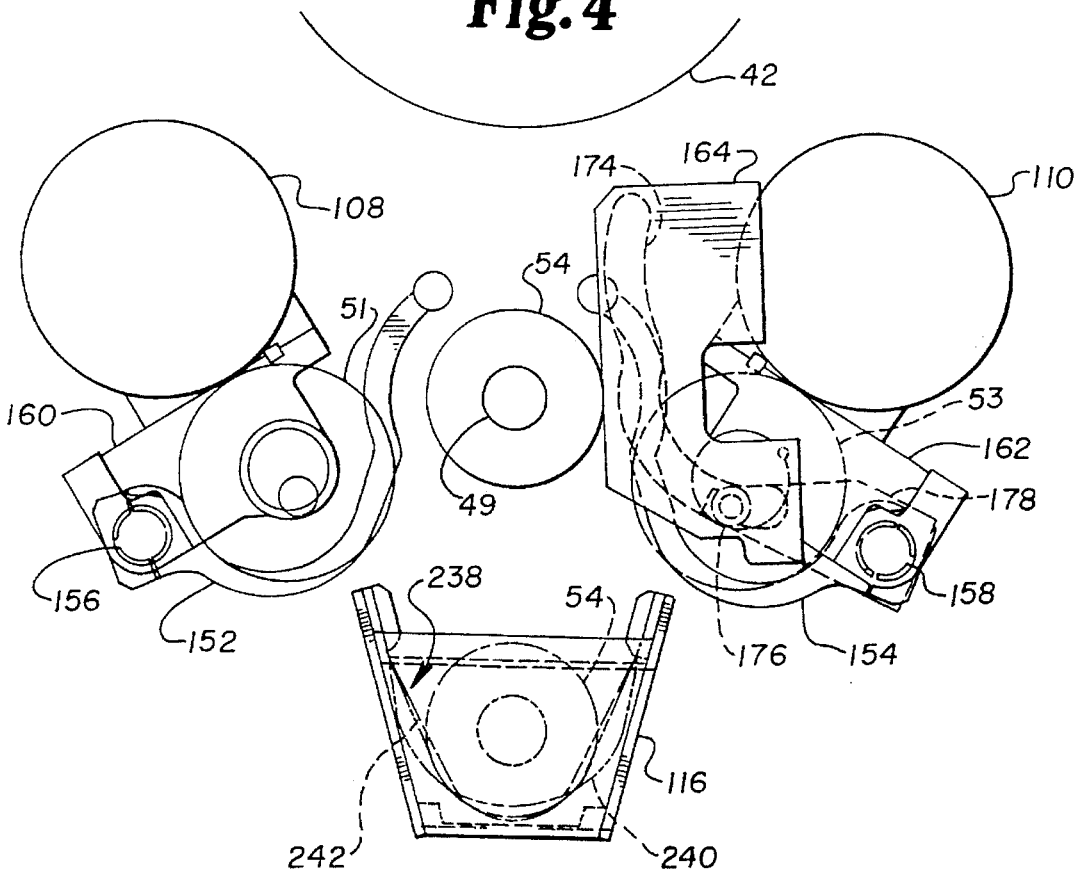
FIG. 4 is a view similar to that of FIG. 3 but with the log released for delivery to a log receiver.

Referring now to FIGS. 3 and 4, once rewinding is completed, the log 54 is separated from winding roll 42 by further pivoting movement of mechanisms 108, 110 moving control rolls 51, 53 away from winding roll 42. It is to be understood that the web of material feeding log 54 has been severed at this point in the rewinding cycle and that log 54 is continuing to rotate, because of its own inertia and because of the driving relationship of the two point contact remaining from rolls 51, 53. At this time the finger position control means are active to position the log control fingers 152, 154 to the second position as shown in FIG. 3, contacting and decelerating the log 54. In the second position of the log control fingers, the fingers form a cavity having a diameter less than the finished diameter of the paper log 54, thus decelerating log 54 to either a stop or a slow enough speed such that is may be further processed by delivering it to retainer or receiver 116. The fingers 152, 154 preferably contact log 54 over a circumferential arc of sufficient length (e.g., approximately 90 degrees or more per finger) to provide significant frictional drag on log 54, rapidly decelerating log 54. Once the log 54 is decelerated sufficiently to permit transfer to receiver 116, the diameter control rolls 51, 53 are further pivoted about the pivoting mechanisms 108, 110, causing the log control fingers 152, 154 to retract to the first position, providing clearance for log 54 to be released, all as shown in FIG. 4. It is to be understood that at this time the diameter control rolls are also moved far enough apart to permit release of log 54. The interior of receiver 116 may either be a smooth, rigid metal liner or a relatively flexible and soft depending loop of material 238, shown in a relaxed state 240 and in a conforming state 242, matching the circumference of log 54 where it contacts the log. The flexible liner material may be a coated fabric or leather belting type material.

Once log 54 is contained in the receiver 116, the receiver 116 (and the log it contains) is moved away from the position shown in FIG. 4 to a log discharge position (not shown).

It is to be understood that the position of log control fingers 152, 154, in the embodiment shown, are controlled by the operation of cam follower 176 received in cam track 174. The follower mounted on one of shafts 156, 158 via its respective follower support arm 178 will move its respective log control finger assembly 152, 154 between the first and second positions as the respective diameter control roll 51, 53 moves during the log rewinding cycle, as illustrated in FIGS. 1–4. Cam follower 176 is driven by track 174 in cam plate 164 which is stationary during the machine cycle but which is adjustable via handwheel or operator cam adjustment handle 206 for different diameter logs 54. Once the cycle has reached the condition shown in FIG. 4, it is to be understood that the machine continues automatically to repeat the cycle starting with the conditions shown in FIG. 1.

Figure 15:
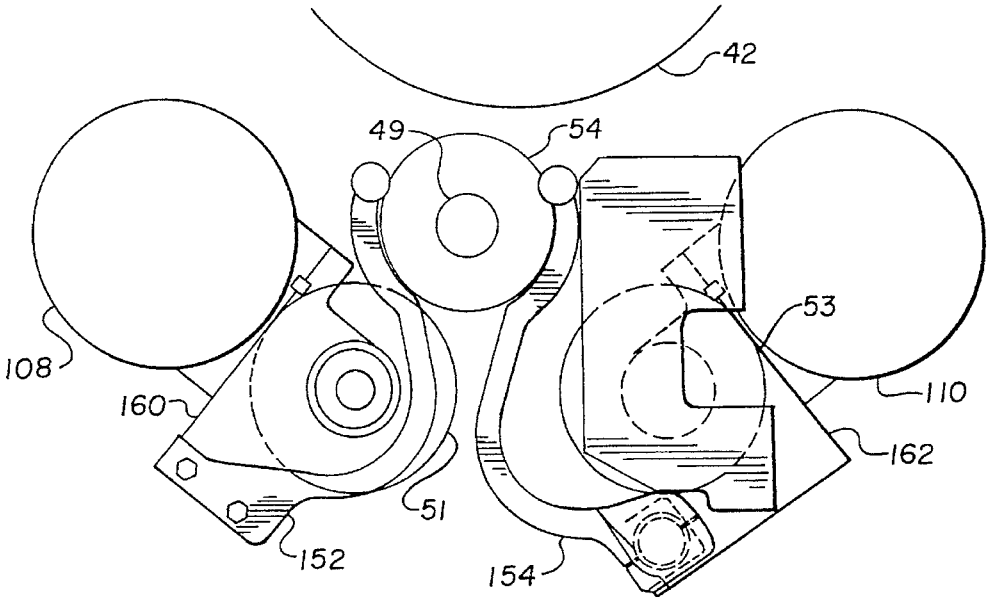
FIG. 15 is an alternative embodiment with only one movable finger in a view similar to that of FIG. 3 with the log rewound and disengaged from the winding rolls and held by the log control fingers during deceleration immediately after completion of the rewinding operation.
Figure 16:
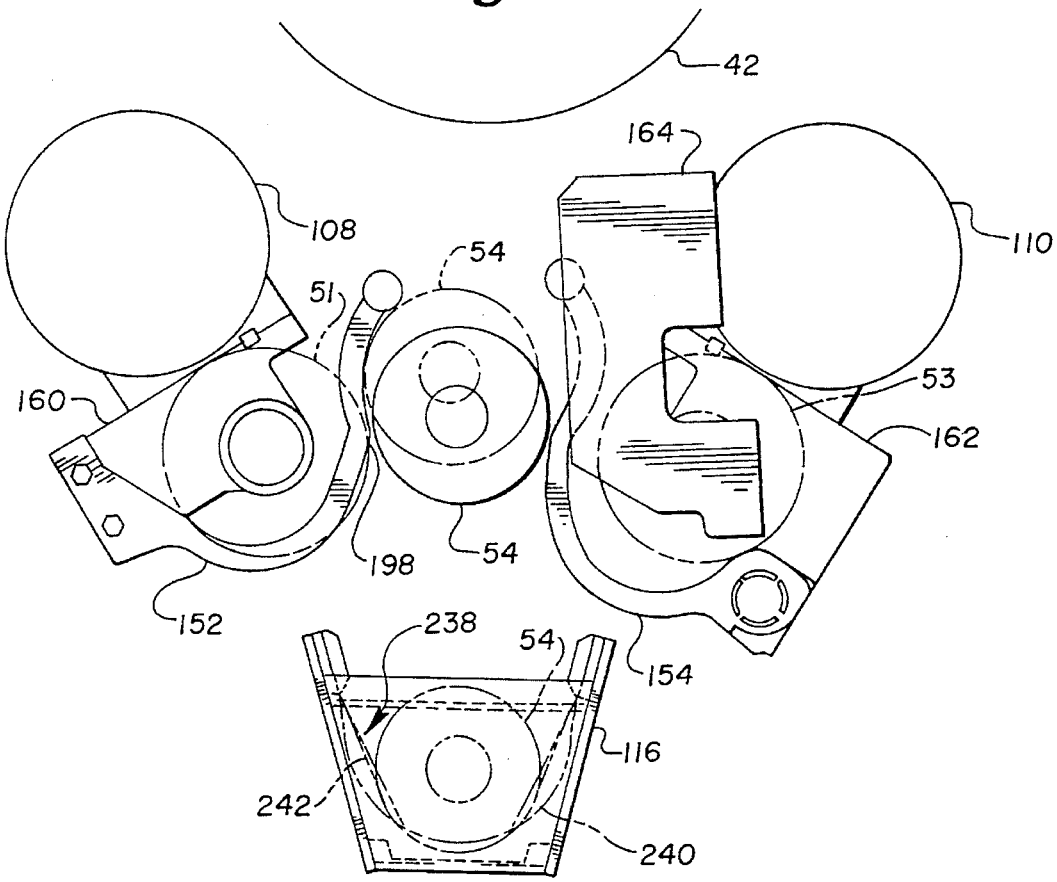
FIG. 16 is a view of the alternative embodiment shown in FIG. 15 at a later position in the cycle showing the log as it is being released to a log receiver.

It is also to be considered within the scope of this invention to provide one fixed log control finger (or similarly functioning stationary structure) and one movable log control finger. More specifically and referring now to FIGS. 15 and 16, finger 152 may be fixed (or remain retracted) while finger 154 can be moved from the clearance position (shown in FIG. 16) along a further distance (equal to twice the distance shown moved by finger 154 in moving from the position shown in FIG. 2 to that shown in FIG. 3) to accomplish the log deceleration, as shown in FIG. 15. In such an arrangement, the position of receiver 116 may desirably be relocated closer to finger 152 (as illustrated in FIG. 16) to position receiver 116 to more accurately receive the released log 54. In this embodiment, log 54 is prevented from contacting roll 51 by discontinuity 198, to prevent scuffing or tearing the outer layers of paper on log 54. In the position shown in FIG. 15, finger 154 moves towards fixed structure or finger 152 until log 54 is moved out of contact with rolls 42, 51 and 53; the log 54 is then decelerated and subsequently released to receiver 116 (as shown in FIG. 16) by finger 154 retracting towards the clearance position (which may also be used for log rewinding).

It is to be noted that the present invention provides for an apparatus and method of decelerating the log immediately in the log rewinding area, defined to be generally the area within the three-point rewinding nips or roll-to-roll contacts. While the log moves slightly (to open the nips) to accomplish deceleration, in the preferred practice of the present invention deceleration of the log occurs while the log is still at least partially in the log rewinding area.

The invention is not to be taken as limited to all of the details thereof as modifications and variations thereof may be made without departing from the spirit or scope of the invention. For example, air or hydraulic cylinders or other known devices may be used as finger position control means in place of the cam follower and track to move the log control fingers between the first and second positions. Furthermore, configurations other than concave may be used for the portion of the log control fingers to decelerate the logs; and while the invention disclosed herein has been found most useful in connection with soft paper logs, it may be used advantageously with relatively hard logs as well, for example, to reduce cycle times for the rewinding machinery. It is also to be understood that while pivoting diameter control rolls are disclosed herein, by "diameter control roll" is meant any roll controlling the log rewinding, whether pivoting or not. In still another embodiment, the fixed finger may be replaced by structure secured to machine frame 12, instead of a pivoting diameter control roll.

What is claimed is:

1. In a rewinder equipment of the type for rewinding small diameter paper logs between a winding roll and a pair of diameter control rolls at a high speed, a rewinder log control comprising:

a.) a pair of log control fingers associated with the diameter control rolls, with one finger positioned on each of opposite sides of a small diameter paper log being rewound; and b.) finger position control means for positioning the log control fingers to i) a first position with respect to the diameter control rolls for providing clearance between the log control fingers in the first position and the paper log being rewound, and ii) a second position wherein the fingers are moved together to circumferentially contact and decelerate the log from a high rewinding speed while the log is still located between the winding roll and the pair of control rolls.

2. The rewinder log control of claim 1 wherein the finger position control means are further operable to position the log control fingers to iii) the first position with respect to the diameter control rolls after deceleration of the completed log to release the completed log.

3. The rewinder log control of claim 1 wherein the log control fingers are located in grooves in the diameter control rolls when the fingers are in the first position.

4. The rewinder log control of claim 3 wherein the log control fingers each have a proximal convex portion adapted to nest in the grooves in the diameter control rolls when the fingers are in the first position.

5. The rewinder log control of claim 4 wherein the log control fingers each have a distal concave portion forming a cavity to receive and decelerate the log when the fingers are in the second position.

6. The rewinder log control of claim 5 wherein the log control fingers further comprise at least one cross-tie member joining the distal concave portions of the log control fingers wherein the cross-tie member is oriented parallel to a cylindrical axis of the diameter control rolls.

7. The rewinder log control of claim 1 further comprising a cam plate rigidly secured to a machine frame of the rewinder equipment and the finger position control means further includes a cam follower carried by the log control fingers and in engagement with a track in the cam plate to move the fingers from the first position to the second position as the diameter control rolls move away from the winding roll.

8. The rewinder log control of claim 7 wherein the cam follower moves the fingers to the first position, providing clearance to release the paper log when the diameter control rolls move apart from each other.

9. The rewinder log control of claim 7 wherein the finger position control means further comprises a cam adjustment handle coupled to the cam plate to move the track with respect to the frame to adjust the position of the fingers in the second position to accommodate different finished diameter paper logs.

10. The rewinder log control of claim 1 wherein the fingers in the second position form a cavity having a diameter less than a finished diameter of the paper log.

11. The rewinder log control of claim 1 wherein the finger position control means holds the fingers in the first position as the fingers move with the diameter control rolls to maintain clearance between the fingers in the first position and the paper log being rewound.

12. A method of decelerating a small diameter paper log after rewinding at a high speed between a winding roll and a pair of diameter control rolls, the steps comprising:

a) moving a pair of log control fingers positioned on opposite sides of said small diameter paper log toward said small diameter paper log while the log is still spinning at a high speed after completion of rewinding the log;

b) decelerating the paper log from the high rewinding speed by circumferential contact between the log and the fingers while the log is still located between the winding roll and the pair of control rolls;

c) retracting the fingers from contact with the paper log to release the log from the fingers after the log is decelerated.

13. The method of claim 12 wherein each of the fingers has a concave portion for circumferentially contacting the paper log in step b).

14. The method of claim 12 further comprising a step preliminary to step a) of:

i) adjusting the position of the fingers to move toward each other and toward said log in step b) to a distance less than the diameter of the paper log.

15. The method of claim 12 wherein the fingers include at least one cross-tie member positioned across a distal end of at least one of the fingers and generally oriented parallel to an axis of the paper log.

16. A method of decelerating a small diameter paper log after rewinding at a high speed in a rewinding area defined by a three point contact with the log in a rewinding apparatus of the type having a winding roll and a pair of diameter control rolls to form the three-point contact with the log, the method comprising the steps of:

a) moving at least one diameter control roll away from the winding roll at the completion of the log rewinding process;

b) moving at least one log control finger towards the small diameter log to circumferentially contact the log such that the log is decelerated from a high rewinding speed in the rewinding area by frictional contact with the log control finger; and c) moving the at least one log control finger out of contact with the log to release the log from the rewinding area.

17. The method of claim 16 wherein step b) further comprises moving a second log control finger towards and into circumferential contact with the log to decelerate the log.

18. The method of claim 17 wherein step c) further comprises moving the second log control finger out of contact with the log to release the log.

19. The method of claim 16 wherein the one log control finger contacts the log along a substantial circumferential arc length in step b).

20. The method of claim 19 wherein the circumferential arc length is greater than sixty degrees.

21. The method of claim 19 wherein the circumferential arc length is approximately ninety degrees.

* * * * *